US007195117B2

(12) United States Patent
Vitye

(10) Patent No.: US 7,195,117 B2
(45) Date of Patent: Mar. 27, 2007

(54) SOAP HOLDING DEVICE

(76) Inventor: Jean Vitye, 239, Chagall, Legardeur, Quebec (CA) J5Z 4K1

( * ) Notice: Subject to any disclaimer, the term of this patent is extended or adjusted under 35 U.S.C. 154(b) by 413 days.

(21) Appl. No.: 10/788,584

(22) Filed: Feb. 28, 2004

(65) Prior Publication Data

US 2005/0189242 A1 Sep. 1, 2005

(51) Int. Cl.
*A47K 5/08* (2006.01)

(52) U.S. Cl. ..... 206/77.1; 206/1.5; 206/460; 206/813; 248/309.2; 248/205.3; 510/447

(58) Field of Classification Search ..... 206/77.1, 206/1.5, 813, 460; 220/293, 296, 301, 480; 248/205.3; 4/628; 215/332, 222; D28/8.1; D6/532, 536, 540
See application file for complete search history.

(56) References Cited

U.S. PATENT DOCUMENTS 1,900,819 A * 3/1933 Jennings ..... 401/81
2,637,143 A * 5/1953 Reynolds et al. ..... 47/41.13
3,380,699 A 4/1968 Fumat
3,597,772 A * 8/1971 Leavitt et al. ..... 4/222
4,361,279 A * 11/1982 Beacham ..... 239/56
4,402,433 A * 9/1983 Webinger ..... 222/485
4,773,103 A * 9/1988 Dahlheimer ..... 4/227.1
4,776,456 A * 10/1988 Lewis ..... 206/15.3
5,242,063 A * 9/1993 Ericksen et al. ..... 211/65
5,450,647 A * 9/1995 Dorsey ..... 15/97.1
6,662,940 B1 * 12/2003 Kowal ..... 206/77.1
D509,890 S * 9/2005 Stavale et al. ..... D23/366

FOREIGN PATENT DOCUMENTS

CA 247064 2/1925

* cited by examiner

*Primary Examiner*—Mickey Yu
*Assistant Examiner*—Steven Pollicoff

(57) ABSTRACT

A soap holding device, besides fixedly holding a cake of soap, allows it to dry rapidly by draining off the water, thus obviating the possibility of a portion of the soap cake getting soft due to contact with moisture.

2 Claims, 5 Drawing Sheets

SOAP HOLDING DEVICE

FIELD OF INVENTION

The present invention relates to the field of soap holding devices and particularly concerned with a wall mounted soap holding device.

BACKGROUND OF THE INVENTION

The invention hereinafter disclosed relates to a wall mounted device used to hold a cake of soap for hand washing, bath or shower use.

The soft slimy outer part of a soap cake which has been soften by wetting is highly unpleasant to many people. The prior art teaches the use of impregnated magnets into a soap cake to hold it in place on steel enameled wash basins or baths, or the use of a mechanical means such as a rod passing through a soap cake in order to connect it to a wall mounted support. There are of course liquid soap held in containers affixed to a surface such as a wall.

SUMMARY OF THE INVENTION

The soap holding device of this instant invention, besides fixedly holding a cake of soap, allows it to dry rapidly by draining off the water, thus obviating the possibility of a portion of the soap cake getting soft due to contact with moisture.

It is therfore an object of the present invention to provide a soap holding device which prevents waste due to softening of a soap cake. Indeed, once installed on the soap holding device, the soap cake is not in contact with any wet surfae. That characteristic of the present invention involves savings comparatively to conventional soap cakes.

It is another object of the present invention to provide a soap holding device which allows to use only one hand to hold a washcloth and to put some soap on it. This advantage of the present invention is really important, for example, when washing a baby or for elderly people with limited mobility.

It is another object of the present invention to provide a soap holding device which has a quick release means to replace a finished cake with a new one thus keeping the same soap holding device.

It is still anather object of the present invention to provide a soap holding device which includes an adhesive surface at its bottom part to allow to fix it, for example, on a vertical wall like in a shower stall or in a sink or a bathtub.

It is a further object of the present invention to provide a soap holding device which is compact, neat and attractive.

It is still a further object of the present invention to provide a soap holding device which has special openings to drain off water to have to soap cake dry more quickly.

It is still a further object of the present invention to provide a soap holding device which will conform to convenient forms of manufacturing, be of simple construction and easy to use, as to provide a soap holding device which will be economically feasable, long lasting and relatively trouble free in operation.

In order to do so, the soap holding device has a custom designed soap configured and shaped to fit within a container having an adhesive band to be permanently affixed to a surface, furthermore, the soap holding device has a self guiding retaining ring that helps reposition the soap cake and the retaining ring onto the seat of the soap holding device when installing a new soap cake, which increases its ease of use.

The foregoing and other objects, features, and advantages of this invention will become more readily apparent from the following detailed description of a preferred embodiment with reference to the accompanying drawings, wherein the preferred embodiment of the invention is shown and described, by way of examples. As will be realized, the invention is capable of other and different embodiments, and its several details are capable of modifications in various obvious respects, all without departing from the invention. Accordingly, the drawings and description are to be regarded as illustrative in nature, and not as restrictive.

DETAILED DESCRIPTION

Figure 1:
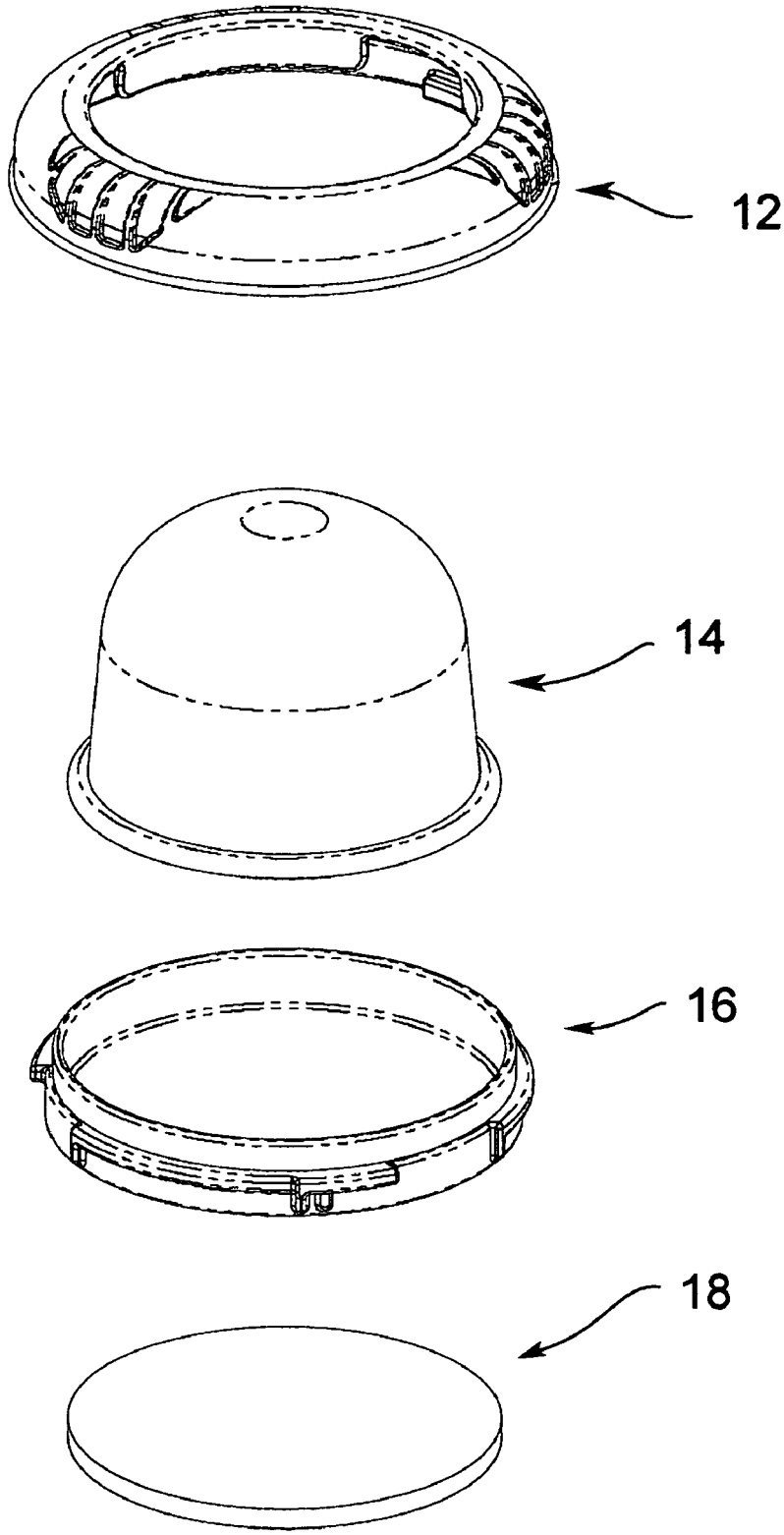
FIG. 1 Exploded view of the components of the soap holding device including a custom shaped cake of soap, illustrates various components part of a soap holding device in accordance with an embodiment of the present invention.

FIG. 1A soap holding device (10) has a retaining ring (12) to retain a cake of custom shaped soap (14) within a bottom seat (16). Underneath that bottom seat (16) is an adhesive disc (18) of the peel off type, well known in the art. The adhesive disc comes pre-glued underneath the bottom seat (14) with the peel off for when installing the soap holding device (10) for the first time.

Figure 2:
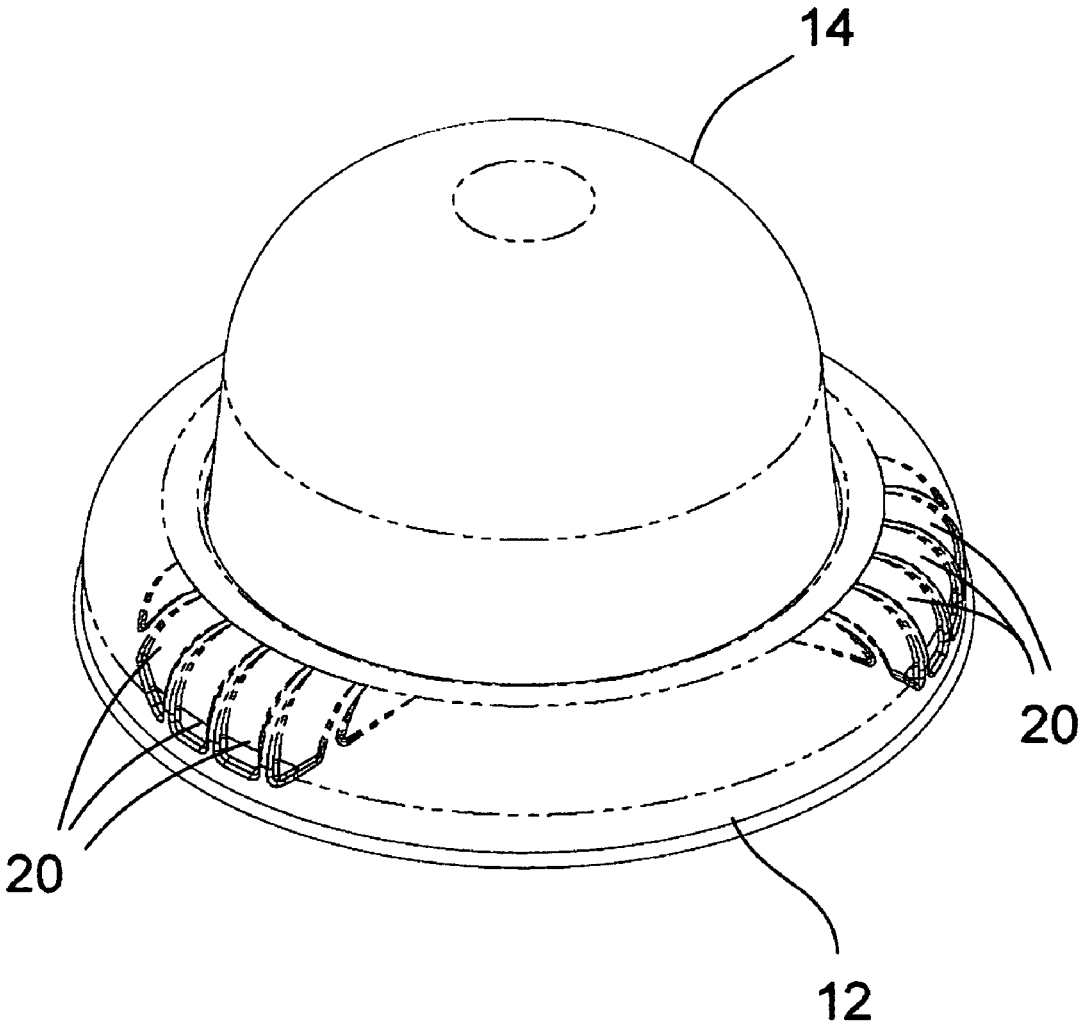
FIG. 2 Perspective view of the soap holding device with the cake of soap.

FIG. 2 When using the soap holding device (10), excess liquid such as soapy water is drained through gateways (20) disposed around the periphery of the retaining ring (12) which encompasses the bottom seat (16).

Figure 3:
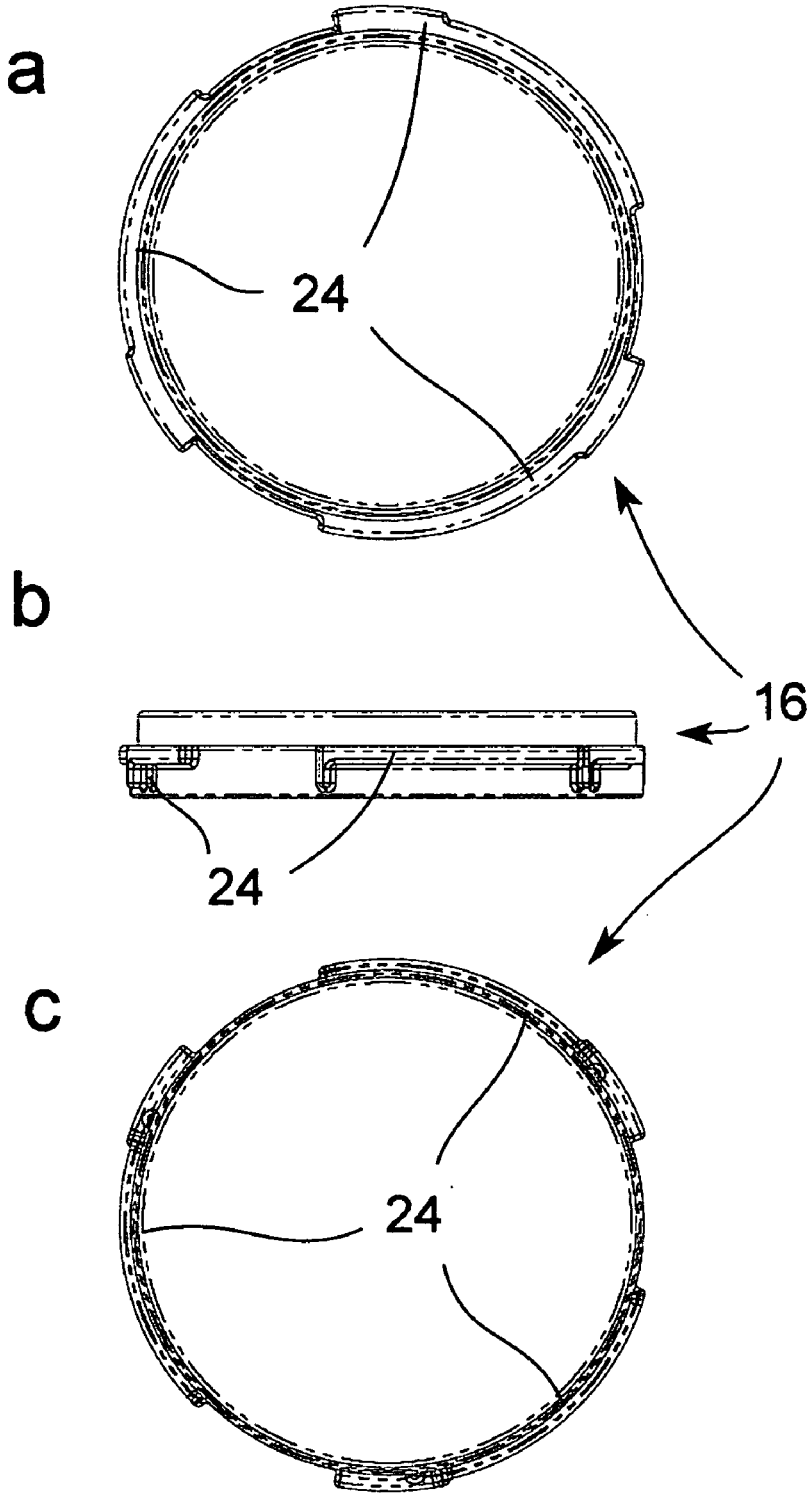
FIG. 3*abc* Top, side and bottom views of the bottom part respectively.
Figure 4:
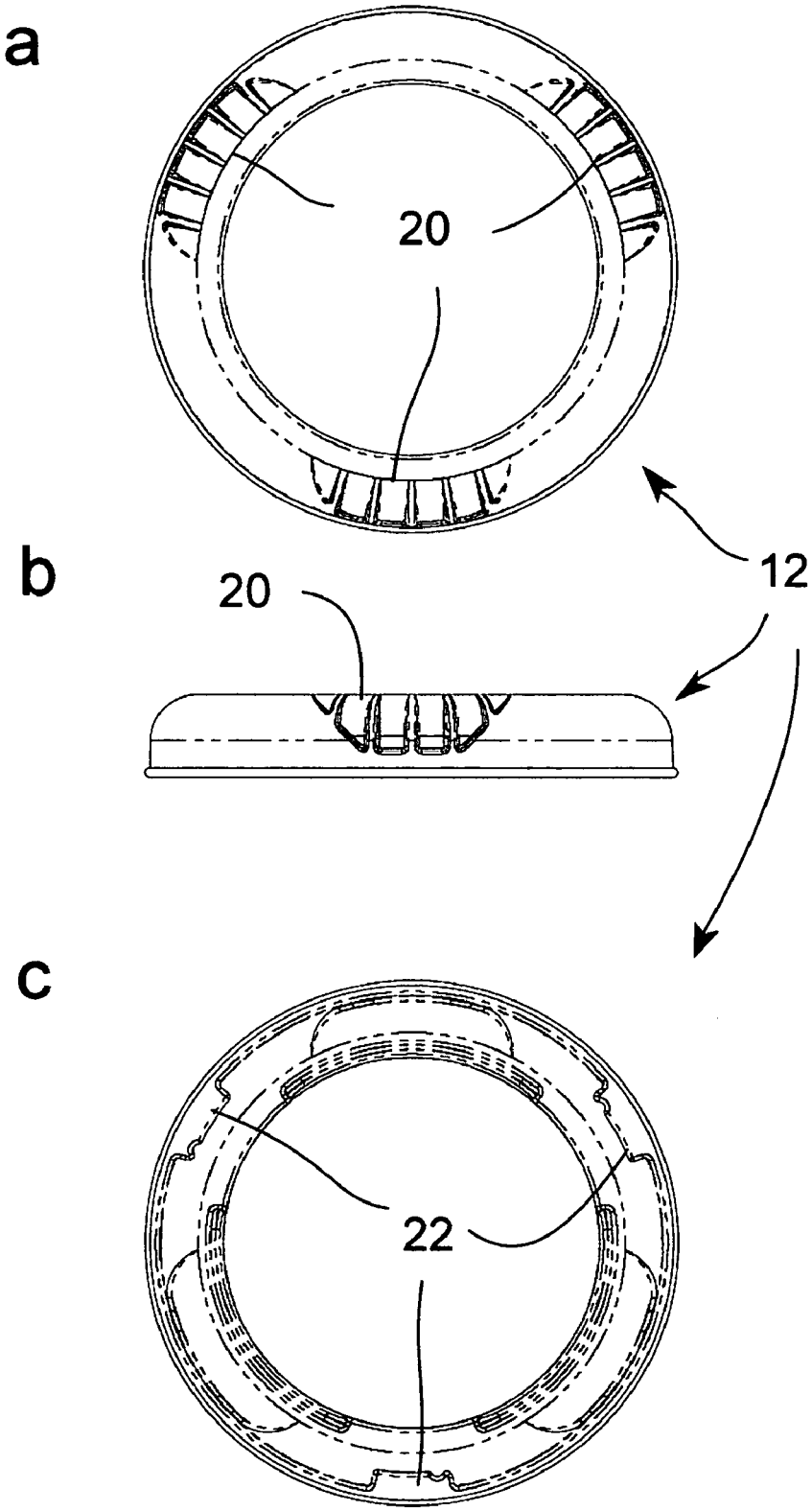
FIG. 4*abc* Top, side and bottom views of the retaining ring respectively.
Figure 5:
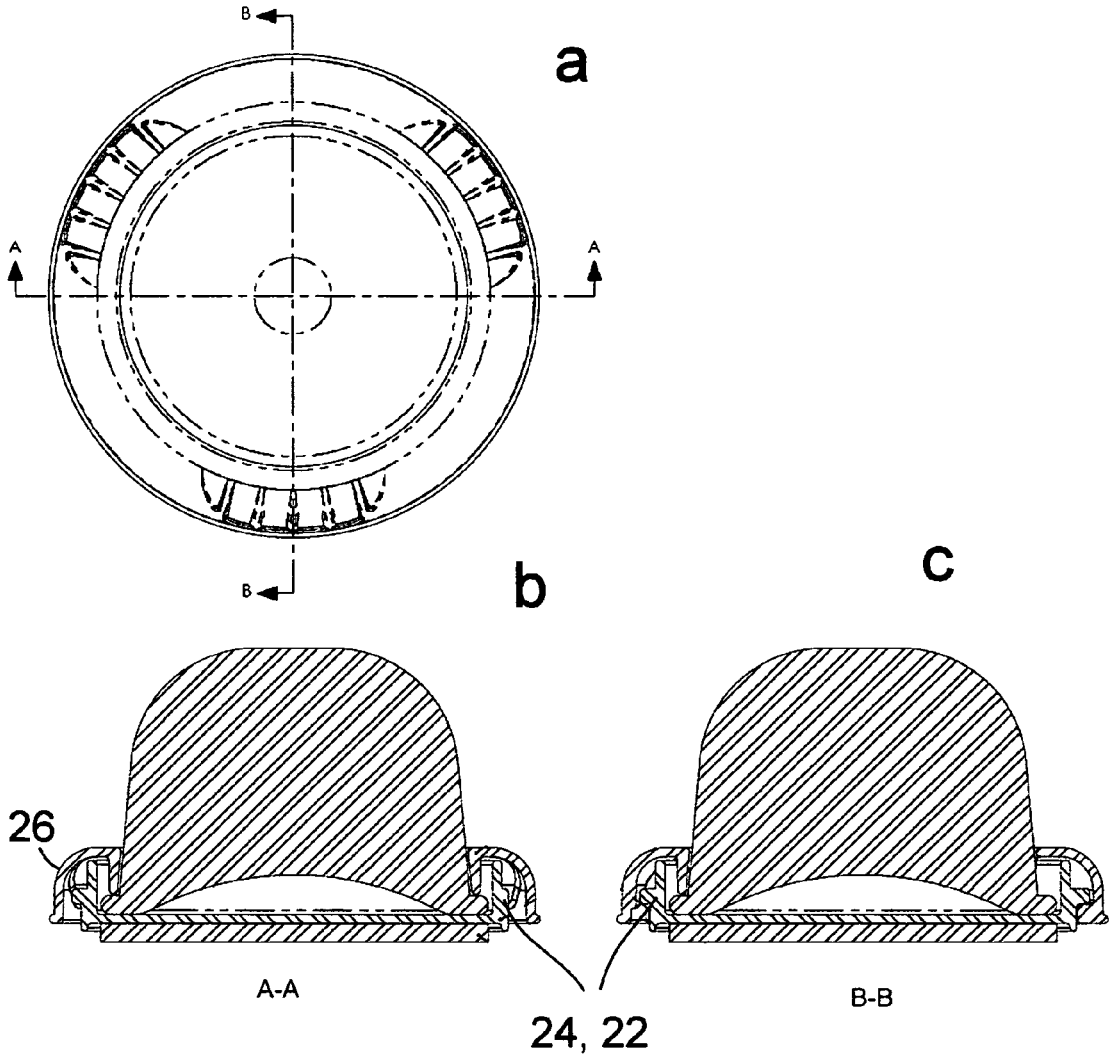
FIG. 5*abc* Top view of retaining ring in a with indication for the cross cutaway views in b and c.

FIGS. 3 and 4 A releasably connecting means connects the retaining ring (12) to complementary connecting means on the bottom seat (16). In a preferred embodiment, the connecting means take on the form of notches (22) and complementary notches (24). Turning the retaining ring (12) slightly, disengages the notches (22) of the retaining ring (12) from the complementary notches (24) from the bottom seat (16). Various configurations of notches (22) and complementary notches (24) and even threaded means properly configured and sized are suitable, all within the scope of this invention. Once the retaining ring (12) is removed, a cake of custom soap (14) is removed (such as when it is used up) to be replaced by a new one and the retaining ring (12), which has a profile designed to be self-guiding by the narrowing of its periphery (26), funnels in onto the bottom part's complementary notches (24) to be retained by the bottom part (16), as can be seen in FIG. 5*abc*.

The invention claimed is:

1. A soap holding device comprising:

A) a retaining ring having:

a) an outer periphery having a plurality of circumferentially arranged apertures to evacuate liquids, b) an inner periphery, wherein said outer and inner peripheries form an annular channel having a plurality of notches;

B) a cylindrical bottom seat having:

a) an open interior recess, b) a plurality of releasable notch engagements along an outer portion of said cylindrical bottom seat for engaging with said notches in said annular channel of said retaining ring;

C) a cake of custom shaped soap, wherein said soap is retained within said open interior recess of said cylindrical bottom seat and a substantial portion of said soap protrudes up through said retaining ring when said plurality of notches is engaged with said plurality of releasable notch engagements of said cylindrical bottom seat;

D) a peel off adhesive disc pre-glued beneath said cylindrical bottom seat for fixing said soap holding device to a surface.

2. A method of replacement of a cake of custom shaped soap from a soap holding device comprising the steps of:

A) disassembling a soap holding device comprising:

a) a retaining ring having:

1) an outer periphery having a plurality of vertically aligned apertures to evacuate liquids, and 2) an inner periphery, wherein said outer and inner peripheries form an annular channel having a plurality of notches;

b) a cylindrical bottom seat having:

1) an open interior recess, 2) a plurality of releasable notch engagements along an outer portion of said cylindrical seat for engaging with said notches in said annular channel of said retaining ring;

c) a cake of custom shaped soap, wherein said soap is retained within said open interior recess of said bottom seat and a substantial portion of said soap protrudes up through said retaining ring when said plurality of notches is engaged with said plurality of releasable notch engagements of said cylindrical bottom seat;

d) a peel off adhesive disc pre-glued beneath said cylindrical bottom seat for fixing said soap holding device to a surface;

B) removing said retaining ring from said cylindrical bottom seat by turning said retaining ring so as to disengage said plurality of notches from said plurality of releasable notch engagements on said cylindrical bottom seat;

C) removing said cake of custom shaped soap from said open interior recess of said cylindrical bottom seat and replacing it with another cake of custom shaped soap;

D) reassembling said retaining ring onto said cylindrical bottom seat.

* * * * *